US012325937B2

(12) United States Patent
Hombach

(10) Patent No.: US 12,325,937 B2
(45) Date of Patent: Jun. 10, 2025

(54) ROUND SLING

(71) Applicant: SPAN SET GESELLSCHAFT FÜR TRANSPORTSYSTEME UND TECHNISCHE BÄNDER MIT BESCHRANKTER HAFTUNG & CO., Übach-Palenberg (DE)

(72) Inventor: Volker Hombach, Mönchengladbach (DE)

(73) Assignee: Span Set Gesellschaft Für Transportsysteme Und Technische Bänder Mit Beschränkter Haftung & Co. Kommanditgesellschaft, Übach-Palenberg (DE)

( * ) Notice: Subject to any disclaimer, the term of this patent is extended or adjusted under 35 U.S.C. 154(b) by 0 days.

(21) Appl. No.: 18/577,030

(22) PCT Filed: Jul. 5, 2022

(86) PCT No.: PCT/EP2022/068584
§ 371 (c)(1),
(2) Date: Jan. 5, 2024

(87) PCT Pub. No.: WO2023/280849
PCT Pub. Date: Jan. 12, 2023

(65) Prior Publication Data

US 2024/0287713 A1 Aug. 29, 2024

(30) Foreign Application Priority Data

Jul. 6, 2021 (DE) ..... 10 2021 003 473.2

(51) Int. Cl.

| | |
|---|---|
| ***D03D 11/02*** | (2006.01) |
| ***D03D 15/56*** | (2021.01) |
| ***D03D 15/573*** | (2021.01) |
| *D03D 13/00* | (2006.01) |

(52) U.S. Cl.
CPC ..... *D03D 11/02* (2013.01); *D03D 15/56* (2021.01); *D03D 15/573* (2021.01); *D10B 2505/00* (2013.01)

(58) Field of Classification Search
CPC ..... D03D 11/02; D03D 15/56; D03D 15/573; D03D 11/00; D03D 15/283; D03D 1/0043;
(Continued)

(56) References Cited

U.S. PATENT DOCUMENTS 1,373,457 A * 4/1921 Smith ..... F16G 1/08 139/387 R
4,015,641 A * 4/1977 Goff, Jr. ..... D03D 11/02 139/384 R
(Continued)

FOREIGN PATENT DOCUMENTS

DE 9209857 U1 10/1992
DE 9214173 U1 1/1993
(Continued)

OTHER PUBLICATIONS

International Search Report issued Oct. 21, 2022, in International Application No. PCT/EP2022/068584.
(Continued)

*Primary Examiner* — Robert H Muromoto, Jr.
(74) *Attorney, Agent, or Firm* — Wood, Phillips, Katz, Clark & Mortimer

(57) ABSTRACT

A round sling for raising loads, consisting of a load-carrying inner nonwoven fabric, which inner nonwoven fabric is formed from a continuous roll of a plurality of supporting threads running substantially parallel to one another and a protective sleeve in the form of a textile protective tube
(Continued)

surrounding the inner nonwoven fabric with a radial degree of freedom, the protective tube being a textile fabric woven from warp and weft threads.

10 Claims, 1 Drawing Sheet

(58) Field of Classification Search
CPC ..... D10B 2505/00; D10B 2331/04; D10B 2331/10; D07B 7/165; D07B 2201/2088; D07B 2201/20903; D07B 2201/2092; B66C 1/12
See application file for complete search history.

(56) References Cited

U.S. PATENT DOCUMENTS 5,273,080 A * 12/1993 Morohashi ..... D03D 11/00 139/408
5,402,832 A * 4/1995 Kamper ..... D03D 1/0043 428/36.1
7,628,435 B1 * 12/2009 Golz ..... B66C 1/18 294/74
8,869,841 B2 * 10/2014 He ..... D03D 17/00 139/420 R
10,786,053 B2 * 9/2020 Siahaan ..... D03D 3/02
2010/0203268 A1 * 8/2010 Russell ..... F16L 11/02 428/34.1

FOREIGN PATENT DOCUMENTS

DE 102011052146 B3 1/2013
DE 202017107079 U1 11/2017
DE 102017127067 A1 5/2019
FR 2959223 A1 4/2010

OTHER PUBLICATIONS

International Preliminary Report on Patentability and Written Opinion issued Dec. 14, 2023, in International Patent Application No. PCT/EP2022/068584.

* cited by examiner

ROUND SLING

BACKGROUND OF THE INVENTION

Field of the Invention

The invention relates to a round sling for lifting loads. Round slings have an inner fabric which bears a load. The inner fabric, also known as the core, is formed from an endless wrap of a plurality of parallel load-bearing threads and is provided with a protective sleeve in the form of a textile tube surrounding the inner fabric with a radial degree of freedom.

Description of Related Art

In the past, textile sheet products with fibre components or yarns with high elongation capacity in relation to their tensile strength, so-called stretch yarns, as disclosed in DE 10 2011 052 A1, were used to improve the stretchability of the protective tube.

Textile sheet products forming the protective tube are also known in which the protective tube is a textile sheet product woven from warp and weft threads, wherein the warp threads running in the longitudinal direction (L) or longitudinal extension of the protective tube consist of fibres or threads with a low elongation capacity in relation to their high tensile strength and the weft threads have a high elongation capacity in relation to their tensile strength. They consist, for example, of stretch fibres or stretch yarns, as disclosed in DE 10 2011 052 146 A1 as well as in FR 2 959 223 A1.

When the round sling is used as a sling according to its function, the fabric expands transversely to the longitudinal direction (L) when this tensile force is applied for example to a load, a load suspension device or a load-bearing device such as a load hook. The additional tube material required as a result is made available from the previously compacted fabric by stretching the weft threads while binding or displacing the warp threads. If a conventional single-layer elastic tube fabric has a high elongation capacity when required, the warp threads can no longer be engaged to maintain a closed fabric surface from a certain elongation. As a result, the warp threads can be easily displaced in the fabric structure and holes tend to form in the tube. The expansions or openings in the fabric represent weak points, as foreign bodies or similar objects can penetrate the protective tube there. Exposed threads may also become detached from the fabric structure due to external influences.

BRIEF SUMMARY OF THE INVENTION

The object of the invention is to optimise the disadvantage of the fabric expansion or the fabric opening when under load with a protective tube as described above.

The objects were achieved by a round sling according to the Main claim 1, wherein the subclaims include more advantageous further embodiments of the invention. Accordingly, the round sling according to the invention has the following features.

The round sling consists of an inner fabric bearing a load, wherein the inner fabric is formed from an endless wrap of a plurality of load-bearing threads running substantially parallel to one another, so-called yarn wraps, and a protective sleeve surrounding the inner fabric with a radial degree of freedom in the form of a protective textile tube, the protective tube is a textile sheet product woven from warp and weft threads, wherein the textile sheet product consists of a multi-layered fabric, the fabric layers of which consist in each case of the warp threads, running in the longitudinal direction (L), also referred to as the longitudinal extension, of the protective tube, consisting of fibres or yarns with a low elongation capacity in relation to their high tensile strength, and the weft threads running substantially transversely to the longitudinal direction in the transverse direction Q and thus also transversely to the warp threads have a high elongation capacity in relation to their tensile strength, wherein the fabric layers of the multi-layered fabric are joined together by further weft threads, so-called connecting threads, running transversely to the longitudinal direction (in transverse direction Q), which have a high elongation capacity in relation to their tensile strength. In the context of the invention, the multi-layered fabric can comprise two or more than two layers.

Advantageously, the further weft threads connect the warp threads of the multi-layered fabric as connecting threads in such a way that they intersect with warp threads, for example also with each warp thread, of the multi-layered fabric.

The elongation capacity of the further weft threads is equal to or lower than the elongation capacity of the weft threads of the multi-layered fabric.

When weft threads and further weft threads are referred to in the plural, within the meaning of the invention this can also refer to only a single weft thread or a further weft thread of a bobbin of the device for producing the protective tube or also threads from a plurality of bobbins.

Where reference is made to the elongation capacity or stretchability, within the meaning of the invention this always refers to an elastic elongation capacity. In this respect, this consists of an elastic extension.

The length of the weft threads and/or the further weft threads can be stretched by 180 percent or more in an elastic range, for example, in a preferred embodiment, up to 250 percent, which is defined as high elongation capacity. The high elongation capacity of the weft threads and/or the further weft threads is thus 1.8-fold to 2.5-fold in the elastic range.

It should be mentioned that the person skilled in the art is also aware that the elongation capacity of the protective tube is also influenced by the elongation capacity of the weft threads and that the weft density, the type of weave and the type of interlacing of the threads also have an influence on the elongation capacity.

In the scope of the invention, the weft threads and/or the further weft threads can consist of an elastane fibre wound with polyester, a high-performance fibre spun with an elastic fibre or of another suitable material.

In a further embodiment, the protective tube has two fabric layers, which in the case of an asymmetrical structure of the protective tube have a different number of weft threads but at least one further weft thread per binding repeat. A combination of one or more connecting threads as further weft threads is also possible within the meaning of the invention, in order to achieve different properties of the layers in terms of stretch behaviour and compactness and to align this with the respectively required properties of the protective tube.

The solution according to the invention creates a more closed fabric structure, so that an expansion or opening of the fabric of the protective tube of the round sling is reduced when under load. The formation of holes and the risk of penetration of foreign bodies are thus reduced.

The invention is explained further in the following with reference to the figures by way of two exemplary embodiments. Further advantages, features, and embodiments of the invention become apparent therefrom.

BRIEF DESCRIPTION OF THE DRAWINGS

FIG. 1.1 shows a schematic representation of the fabric of a protective tube of a round sling in a tensioned state, wherein the further weft threads intersect with each warp thread of the two fabric layers.

FIG. 2.1 shows a schematic representation of a further fabric of a protective tube of a round sling in a tensioned state, wherein the further weft threads float over three warp threads of the two fabric layers before they intersect with the layers.

DETAILED DESCRIPTION OF THE INVENTION

Figure 1:
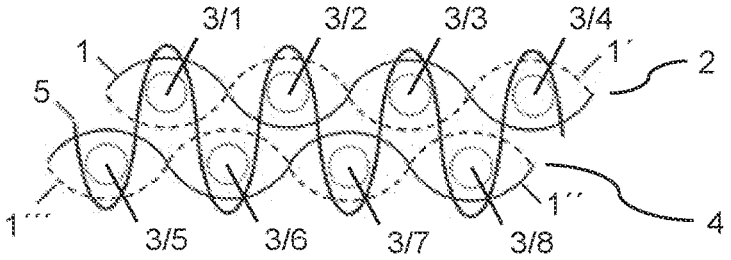
FIG. 1 shows a schematic representation of a fabric of a protective tube of a round sling in a relaxed state, wherein the further weft threads intersect with each warp thread of the two fabric layers.
Figure 1:
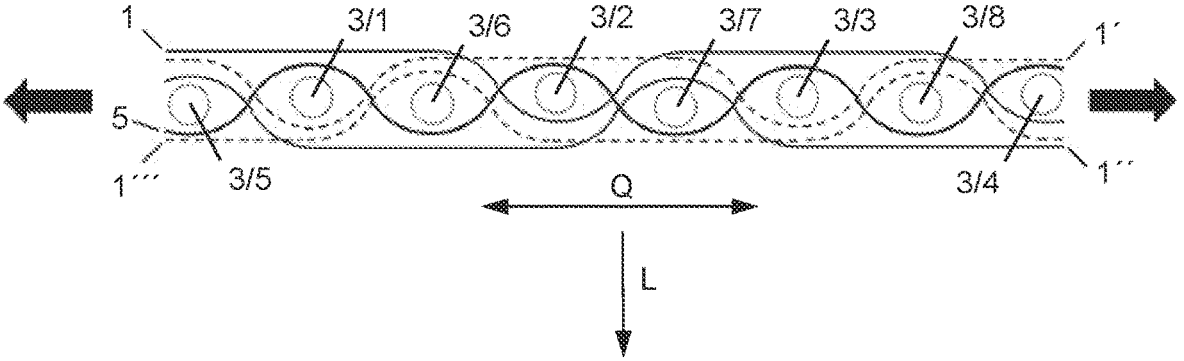

In both exemplary embodiments the multi-layered fabric consists of only two fabric layers.

The elastic weft threads 1 and 1' in combination with the warp threads 3/1 to 3/4 form a first fabric layer 2. The elastic weft threads 1" and 1''' form a further fabric layer 4 with the warp threads 3/5 to 3/8. The warp threads 3 of the first fabric layer 2 and the further fabric layer 4 run in longitudinal direction L, i.e. in the direction of the longitudinal course of the round sling. The weft threads 1' to 1''' run in transverse direction Q, at right angles to the longitudinal direction L of the round sling. The first and further fabric layers 2, 4 are connected by further elastic weft threads 5, which also run in the transverse direction Q, FIG. 1.

Under transverse load, the first and further fabric layer 2, 4 stretch as shown in FIG. 1.1. The spaces between the warp threads 3/1 to 3/4 of the first fabric layer 2 which are normally present in a single-layer transversely elastic fabric, are now filled with the warp threads 3/5 to 3/8 of the further fabric layer 4 and are thus completely or at least partially filled. When the protective tube of the round sling is stretched in transverse direction Q the warp threads lying on top of one another endeavour to arrange themselves next to each other due to the tension of the further weft threads 5, FIG. 1.1. The warp threads 3/1 to 3/8 therefore lie in the arrangement 3/5, 3/1, 3/6, 3/2, 3/7, 3/3, 3/8 and 3/4 after stretching the protective tube of the round sling in transverse direction Q.

Figure 2:
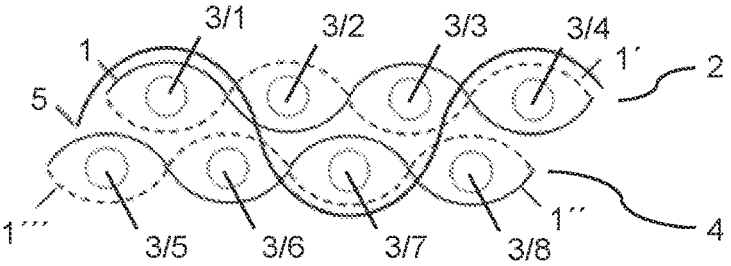
FIG. 2 shows a schematic representation of a further fabric of a protective tube of a round sling in a relaxed state, wherein the further weft threads float over three warp threads of the two fabric layers before they intersect with the layers.
Figure 2:
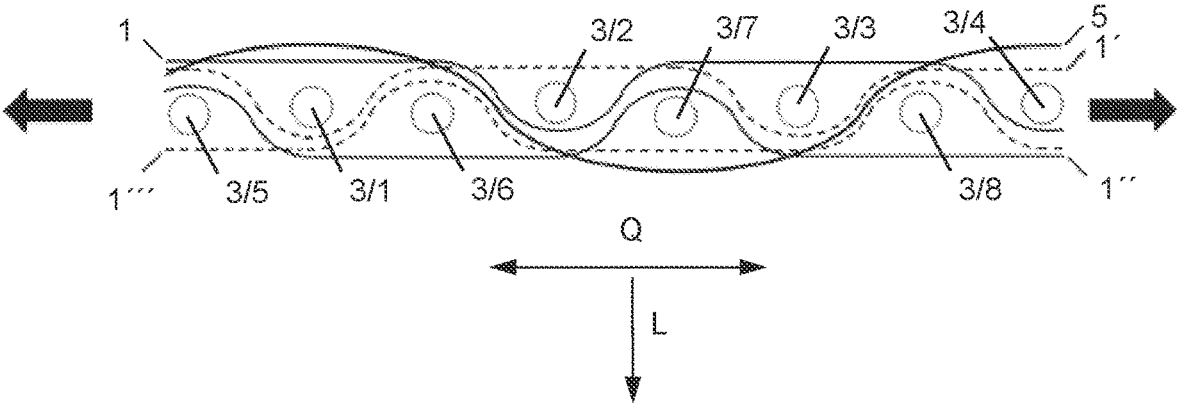

FIG. 2 shows a further exemplary embodiment of the round sling according to the invention, wherein in FIGS. 2 and 2.1, as also shown in FIGS. 1 and 1.2, a portion of a protective tube of the round sling is shown schematically as part of a textile sheet product. A representation of a cross-section of the round sling as such with its inner fabric, which is formed as an endless wrap from a plurality of load-bearing threads running substantially parallel in the longitudinal direction L, wherein the inner fabric is surrounded and enclosed by the protective tube as a textile sheet product with a radial degree of freedom, is not shown, as this is familiar to the person skilled in the art, for example from the prior art mentioned above.

FIGS. 2 and 2.1 show an example of a different arrangement of the further weft threads 5 in the fabric of the protective tube of the round sling, wherein the fabric is also multi-layered and consists of the first and the further fabric layer 2, 4 and is formed in the same way as the first exemplary embodiment according to FIGS. 1 and 1.1. except for the insertion of the further weft threads 5.

In this exemplary embodiment, the further elastic weft threads 5 float over three warp threads 3, before they intersect with the fabric layers, which leads to a less strong weave compared to the arrangement in FIG. 1 which provides an intersection with each warp thread, and thus enables greater stretchability of the fabric of the protective tube of the round sling in transverse direction Q, which is shown in FIG. 2.1. The warp threads 3/1 to 3/8 are in the same arrangement as shown in FIG. 1.1 and explained above after the protective tube of the round sling has been stretched in the transverse direction Q. In general, the further weft threads 5 can also be floated over two or more warp threads 3 before they intersect with the fabric layers.

The stretching behaviour of the fabric of the protective tube of the round sling is also influenced by the frequency of insertion of the further weft threads 5, so that in addition to a double weft, it is also possible to skip the insertion of the further weft threads 5 over several weft threads, so that the most homogeneous possible stretching behaviour of the protective tube can be achieved in transverse direction Q. This depends on the respective requirements placed on the round sling according to the invention.

According to the two exemplary embodiments, only a limited number of warp threads are available in a two-layer protective sleeve. Therefore, the advantageous effect according to the invention decreases with increasing elongation of the protective sleeve in the transverse direction Q, so that when the round sling is overloaded, a hole-forming expansion of the multi-layered fabric of the protective tube is to be expected, which can also be an indication of overloading, so that the person skilled in the art has to immediately interrupt the handling of the round sling when such an indication is given.

LIST OF REFERENCE NUMBERS

1. weft threads
2. first fabric layer
3. warp threads
4. further fabric layer
5. further weft threads
Q transverse direction
L longitudinal direction

The invention claimed is:

1. A round sling consisting of an inner fabric for bearing a load, wherein the inner fabric is formed by an endless wrap of a plurality of load-bearing threads running substantially parallel to one another and a protective sleeve surrounding the inner fabric with a radial degree of freedom in the form of protective textile tube, the protective tube being a textile sheet product woven from warp and weft threads (3), (1), wherein the textile sheet product consists of a multi-layered fabric, the fabric layers of which each have the warp threads (3) which run in the longitudinal direction (L) or longitudinal extension of the protective tube, said warp threads consisting of fibres or yarns with a low elongation capacity in relation to their high tensile strength, and the weft threads (1) running transversely to the longitudinal direction, in transverse direction (Q), have a high elongation capacity in relation to their tensile strength, wherein the fabric layers of the multi-layered fabric are connected to one another by further weft threads (5) running transversely to the longitudinal direction, said weft threads having a high elongation capacity in relation to their tensile strength.

2. The round sling according to claim 1, wherein the further weft threads (5), as connecting threads, connect the warp threads (3) of the multi-layered fabric, which leads to an intersection with warp threads (3) of the multi-layered fabric.

3. The round sling according to claim 1, wherein the further weft threads (5), as connecting threads, connect the warp threads (3) of the multi-layered fabric, which leads to an intersection with each warp thread (3) of the multi-layered fabric.

4. The round sling according to claim 1, wherein, in the case of an asymmetrical structure of the protective tube, the two fabric layers have different numbers of weft threads (5) but at least one further weft thread per binding repeat.

5. The round sling according to claim 1, wherein the multi-layered fabric consists of two or more than two layers.

6. The round sling according to claim 1, wherein the further weft threads (5) float over two or more warp threads (3) of the two fabric layers, before they intersect with the fabric layers.

7. The round sling according to claim 1, wherein the elongation capacity of the further weft threads (5) is equal to or lower than the elongation capacity of the weft threads (1) of the multi-layered fabric.

8. The round sling according to claim 1, wherein the high elongation capacity of the weft threads (1) and/or of the further weft threads (5) is 1.8-fold to 2.5-fold in the elastic range.

9. The round sling according to claim 1, wherein the weft threads (1) and/or the further weft threads (5) consist of an elastane fibre wound with polyester or of a high-performance fibre spun with an elastic fibre.

10. The round sling according to claim 1, wherein the elongation capacity of the fabric of the protective tube of the round sling depends on the insertion frequency of the further weft threads (5).

* * * * *